US008099806B2

(12) United States Patent
Chepurny et al.

(10) Patent No.: US 8,099,806 B2
(45) Date of Patent: Jan. 24, 2012

(54) ADJUSTABLE SUPPORT FRAME

(75) Inventors: Mark Chepurny, Bradford (CA); Mikel Shani, Mississauga (CA)

(73) Assignee: Prism Medical Ltd., Mississauga, Ontario (CA)

( * ) Notice: Subject to any disclaimer, the term of this patent is extended or adjusted under 35 U.S.C. 154(b) by 1201 days.

(21) Appl. No.: 10/575,115

(22) PCT Filed: Oct. 8, 2004

(86) PCT No.: PCT/CA2004/001834
§ 371 (c)(1),
(2), (4) Date: May 14, 2007

(87) PCT Pub. No.: WO2005/132446
PCT Pub. Date: Apr. 14, 2005

(65) Prior Publication Data
US 2007/0274817 A1 Nov. 29, 2007

(51) Int. Cl.
*A61G 7/14* (2006.01)

(52) U.S. Cl. ..... 5/81.1 R; 5/83.1; 5/85.1

(58) Field of Classification Search ..... 5/81.1 R, 5/83.1, 84.1, 85.1, 86.1
See application file for complete search history.

(56) References Cited

U.S. PATENT DOCUMENTS

| | | | | |
|---|---|---|---|---|
| 1,098,477 | A | 6/1914 | Cashman | |
| 1,505,437 | A | 8/1924 | Scwheizer | |
| 1,536,766 | A | 5/1925 | Cammann | |
| 2,027,795 | A | 1/1936 | Stephenson | |
| 2,272,778 | A | 2/1942 | Reuter | |
| 2,368,390 | A | 1/1945 | Winter | |
| 2,490,130 | A | 12/1949 | Hollis | |
| 2,598,570 | A * | 5/1952 | Lewis | 212/345 |
| 4,571,758 | A | 2/1986 | Samuelsson | |
| 4,944,056 | A | 7/1990 | Schroeder et al. | |
| 5,056,753 | A * | 10/1991 | Lunau et al. | 248/542 |
| 5,158,188 | A | 10/1992 | Nordberg | |
| 5,181,289 | A | 1/1993 | Kassai | |
| 5,337,908 | A | 8/1994 | Beck, Jr. | |
| 5,527,054 | A | 6/1996 | Williams | |
| 6,575,100 | B2 * | 6/2003 | Faucher et al. | 104/126 |

FOREIGN PATENT DOCUMENTS

CA 2303619 9/2001

* cited by examiner

*Primary Examiner* — Fredrick Conley
(74) *Attorney, Agent, or Firm* — The Webb Law Firm

(57) ABSTRACT

A frame for supporting and moving a load, the frame comprising first and second support legs for supporting said frame on at least one floor; a load support member, extending between the first support leg and the second support leg, wherein the load support member is sized and shaped to be length adjustable; and a trolley, movably mounted on an external surface of the load support member, the trolley and load support member being sized and shaped to permit the trolley to move along the load support member; whereby access to the trolley, without removing same from the load support member, is facilitated.

21 Claims, 12 Drawing Sheets

ADJUSTABLE SUPPORT FRAME

FIELD OF THE INVENTION

This invention relates to the field of care for the handicapped and the elderly. In particular, this invention relates to devices for lifting and moving the elderly and handicapped.

BACKGROUND OF THE INVENTION

Disabled persons who cannot move on their own will often require the assistance of caregivers in leaving bed, or in moving from one place to another. Even if such a disabled person is capable of using a transportation device, such as a wheelchair, additional assistance is still often required. For example, disabled persons will often require assistance in moving to and from a wheelchair, to and from the toilet, and to and from a bathing area. In addition, such disabled persons often require assistance in moving and supporting themselves in the context of receiving physical therapy.

A number of devices exist for lifting and moving disabled persons from one place to another. An example is disclosed in U.S. Pat. No. 5,158,188 ("Nordberg"). Nordberg discloses a portable patient moving system that can be erected within a room to form a pipe frame on which a travelling bridge and hoist trolley are mounted. The apparatus of Nordberg permits "complete x, y movement" throughout the room.

However, the apparatus of Nordberg is unwieldy, containing a large number of long pieces that make up the pipe frame. Though technically portable, it is not easily adapted to different rooms of widely varying sizes.

Another example of such an apparatus is disclosed in U.S. Pat. No. 4,571,758 ("Samuelsson"). Samuelsson discloses a lifting and carriage apparatus for use in close or crowded environments. The apparatus includes a post, securely fixed to a floor, with a cantilevered arm that allows for both radial and rotational movements of the patient. Although the device of Samuelsson must be fixed to the floor, the operating portion can be removed and installed in another fixed base element at a different location.

The apparatus of Samuelsson is deficient in a number of ways. First, the apparatus of Samuelsson requires the fixing of a base element to the floor. This is sometimes impossible, or inconvenient, depending on the nature of the floor itself, and the location where assistance for a disabled person is required. In addition, the apparatus of Samuelsson provides for radial movement using a single I-beam extending outwardly from the central post. Such a configuration is not easily adaptable to varying circumstances. On the one hand, radial movement beyond the length of the I-beam is not possible. On the other hand, in circumstances where it is not necessary to move the disabled person as far as the length of the I-beam, the I-beam takes up unnecessary space. Also, because the I-beam is cantilevered from the central post, the distance from the post to which a disabled person can be transported is sharply limited by engineering constraints.

Canadian patent application 2,303,619 ("Faucher et al.") discloses a support structure consisting of two or, optionally, three support legs having floor pads attached thereto for resting on a floor. The support legs further include paddles at their top ends for pushing against a ceiling in order to stabilize the apparatus. The apparatus further includes a crossbar consisting of two telescopically mating rods which slide relative to one another, and carry a trolley on an internal surface of the crossbar (i.e. within a hollow centre of the crossbar).

The device of Faucher et al. suffers from a number of problems. First, to stabilize the apparatus, pressure against a ceiling is required. Under some circumstances, an appropriate ceiling may not be available, depending on the architecture of the building in which the apparatus is being used.

Second, it is often desirable to have access to the trolley wheels without having to disassemble the apparatus. If there is an apparent malfunction, a user will want to have access to the trolley wheels to determine if and how they are the source of the problem. If there is a problem with the trolley wheels, it is often convenient to perform repairs without disassembling the apparatus. In Faucher et al., because the trolley is internally mounted, the wheels are practically inaccessible for inspection and repair purposes.

SUMMARY OF THE INVENTION

Therefore, what is required is a device wherein the distance that the patient (or any other type of load) can be transported is adjustable. The adjustable support frame will also include a trolley mounted so as to provide easier access to the trolley for inspection and repair. Preferably, the adjustable support frame will be easily adaptable for use in spaces having different configurations and architectures, and will be easy to assemble, disassemble and transport.

Therefore, according to the present invention, there is provided a frame for supporting and moving a load, the frame comprising:

first and second support legs for supporting said frame on at least one floor;

a load support member, extending between the first support leg and the second support leg, wherein the load support member is sized and shaped to be length adjustable;

a trolley, movably mounted on an external surface of the load support member, the trolley and load support member being sized and shaped to permit the trolley to move along the load support member;

whereby access to the trolley, without removing same from the load support member, is facilitated.

Preferably, the load support member comprises a first elongate member coupled to the first support leg and a second elongate member coupled to the second support leg, the elongate members being sized and shaped such that the first elongate member is axially slidably mateable with the second elongate member to form said load support member, whereby the length of the load support member is adjustable by axially sliding the first elongate member relative to the second elongate member when the elongate members are mated.

Preferably, the frame further comprises a floor-only stabilizer means, associated with said support legs, for stabilizing said frame in a standing position, said floor-only stabilizer means being sized and shaped to stabilize said frame in a standing position by acting only on the at least one floor.

Preferably, the first support leg and second support legs are configured to be height adjustable independently from one another, whereby the frame may be effectively used with the first support leg resting on a first floor having a level and the second support leg resting on a second floor having a different level.

Preferably, the first support leg comprises a first upper section attached to the load support member and a first lower section coupled to the first upper section, the first upper section being axially slidably mateable with the first lower section, wherein the height of the first support leg is adjustable by sliding the first upper section relative to the first lower section; and the second support leg comprises a second upper section attached to the load support member and a second lower section coupled to the second upper section, the second upper section being axially slidably mateable with the second lower section, wherein the height of the second support leg is adjustable by sliding the second upper section relative to the second lower section.

Preferably, the frame further comprises a first height adjustment means, associated with the first upper and lower sections, for independently and continuously adjusting the height of the first support leg, and a second height adjustment means, associated with the second support leg, for independently and continuously adjusting the height of the second support leg.

Preferably, the legs are configured to be detachable from the load support member; and the first support leg comprises a first upper section attached to the load support member and a first lower section coupled to the first upper section, the first upper section being axially slidably mateable with the first lower section, wherein the height of the first support leg is adjustable by sliding the first upper section relative to the first lower section; and the second support leg comprises a second upper section attached to the load support member and a second lower section coupled to the second upper section, the second upper section being axially slidably mateable with the second lower section, wherein the height of the second support leg is adjustable by sliding the second upper section relative to the second lower section; and the first upper section and first lower section are sized and shaped to be decouplable by sliding the first upper section axially away from the first lower section, and the second upper section and second lower section are sized and shaped to be decouplable by sliding the second upper section axially away from the second lower section.

BRIEF DESCRIPTION OF THE DRAWINGS

Reference will now be made, by way of example only, to drawings of the invention, which illustrate the preferred embodiment thereof, and in which.

DETAILED DESCRIPTION OF THE PREFERRED EMBODIMENTS

Figure 1:
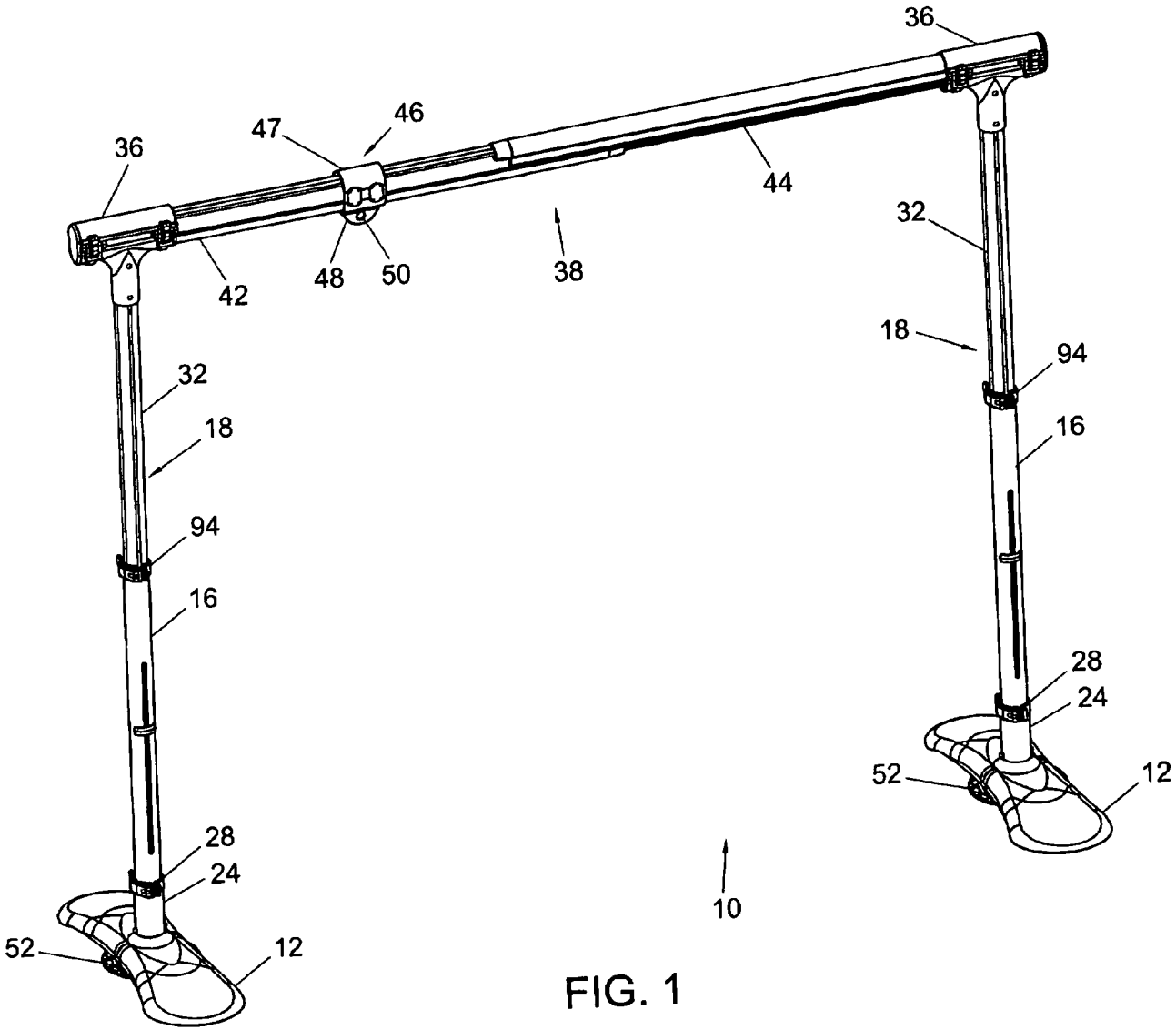
FIG. 1 is a perspective view of the adjustable support frame in its assembled condition.

Referring now to FIG. 1, the adjustable support frame 10 is shown, resting on one or more floors (not shown). The frame 10 comprises first and second stabilizer feet 12 which together, in the preferred embodiment, form the floor-only stabilizer means according to the present invention. It will be appreciated that the invention comprehends other forms of floor-only stabilizer means. What is important is that the floor-only stabilizer means be sized and shaped to stabilize the frame 10 in a standing by position by acting only on the floor (or floors) on which the frame rests.

The first and second stabilizer feet 12 are coupled to, and thus associated with, the lower sections 16 of the first and second support legs 18. Attached to the stabilizer feet 12 are support leg receiving portions 24 which receive and engage the lower sections 16 respectively. Rigidity clamps 28 are positioned at the junctions between the lower sections 16 and the support leg receiving portions 24. The rigidity clamps 28, when tightened, substantially reduce the play between the lower sections 16 and the support leg receiving portions 24 to further stabilize the adjustable support frame 10, to make it more rigid and prevent movement when in use. Coupled to the lower sections 16 are the upper sections 32 of the support legs 18.

At the top end of each upper section 32 is a load support member clamp 36 for detachably attaching the load support member 38 to the support leg 18.

In the preferred embodiment, the support legs 18 and the load support member 38 are shaped and positioned such that, when the frame 10 is assembled, the legs 18 and member 38 lie substantially in a single plane. Also, preferably, the feet 12 extend away from the plane, on both sides of the plane, sufficiently so as to stabilize the frame in a standing position while acting only on the floor on which the frame 10 rests. It will be appreciated that the extending feet exert a force on the floor(s) to keep the frame upright, thus obviating the need for the stabilizer mean to act on another surface besides the floor(s).

The load support member 38 comprises a first or lower elongate member 42, detachably attached by a clamp 36 to the first upper section 32. The load support 38 further includes a second or upper elongate member 44, detachably attached by a clamp 36 to the second upper section 32. Thus, the member 38 extends between the first and second support legs 18. As will be more particularly described below, the member 38 is sized and shaped to be length adjustable. Thus, the frame can be adjusted to permit longer or shorter movement of the load, depending on the distance the load needs to be moved, and the dimensions of the space itself.

In the preferred embodiment, the upper elongate member 44 and the lower elongate member 42 are sized and shaped so as to be axially slidably mateable with one another. In other words, the two elongate members 42, 44 are sized and shaped so that when slidably mated, they can only be separated or detached from one another only by sliding the members 42, 44 apart in an axial direction (i.e. along the length of the elongate members), but are otherwise mated with one another so that they form a functioning load support member for supporting a load.

A trolley 46 is mounted on the load support member 38. The trolley 46 includes a trolley cover 47, and a flange 48 having a hole 50 therethrough for attaching a load to be supported and/or moved. The trolley 46 further includes four trolley wheels 49. When the frame 10 is in its assembled condition, the trolley 46 is mounted on an external surface of the load support member by virtue of the trolley wheels 49 being positioned on the external wheel-bearing surface (described below) of the member 38. The wheels 49 permit the trolley 46 to move along the member 38 on the external wheel bearing surface.

In the preferred embodiment, the lower elongate member and the upper elongate member are sized and shaped to permit the trolley to move along substantially the entirety of the load supporting member 38 between the clamps 36. The specific configuration of the elongate members 42, 44 will be more particularly described below. However, it will be appreciated that, because the elongate members 42, 44 are axially slidably mateable with one another, the length of the load support member 38, and the width of the frame 10 (i.e. the distance between the first and second support legs 18) are adjustable by moving the elongate members 42, 44 relative to one another. Furthermore, regardless of whether the width of the frame is smaller or larger, the trolley 46 can move along substantially the entirety of the load support frame 38. It will be appreciated that the member 38 need not have the specific configuration described here. What is important is that the member 38 be sized and shaped so as to be length adjustable.

Most preferably, the trolley cover 47 surrounds the load support member 38 sufficiently so that if the trolley 46 fails, for example, by the wheels 49 failing, the cover 47 will grip the load support member, supporting the load. It will be appreciated that this safety feature is facilitated by the mounting of the trolley 46 on an external surface of the member 38, which allows the cover 47 to externally surround the member 38.

Figure 11:
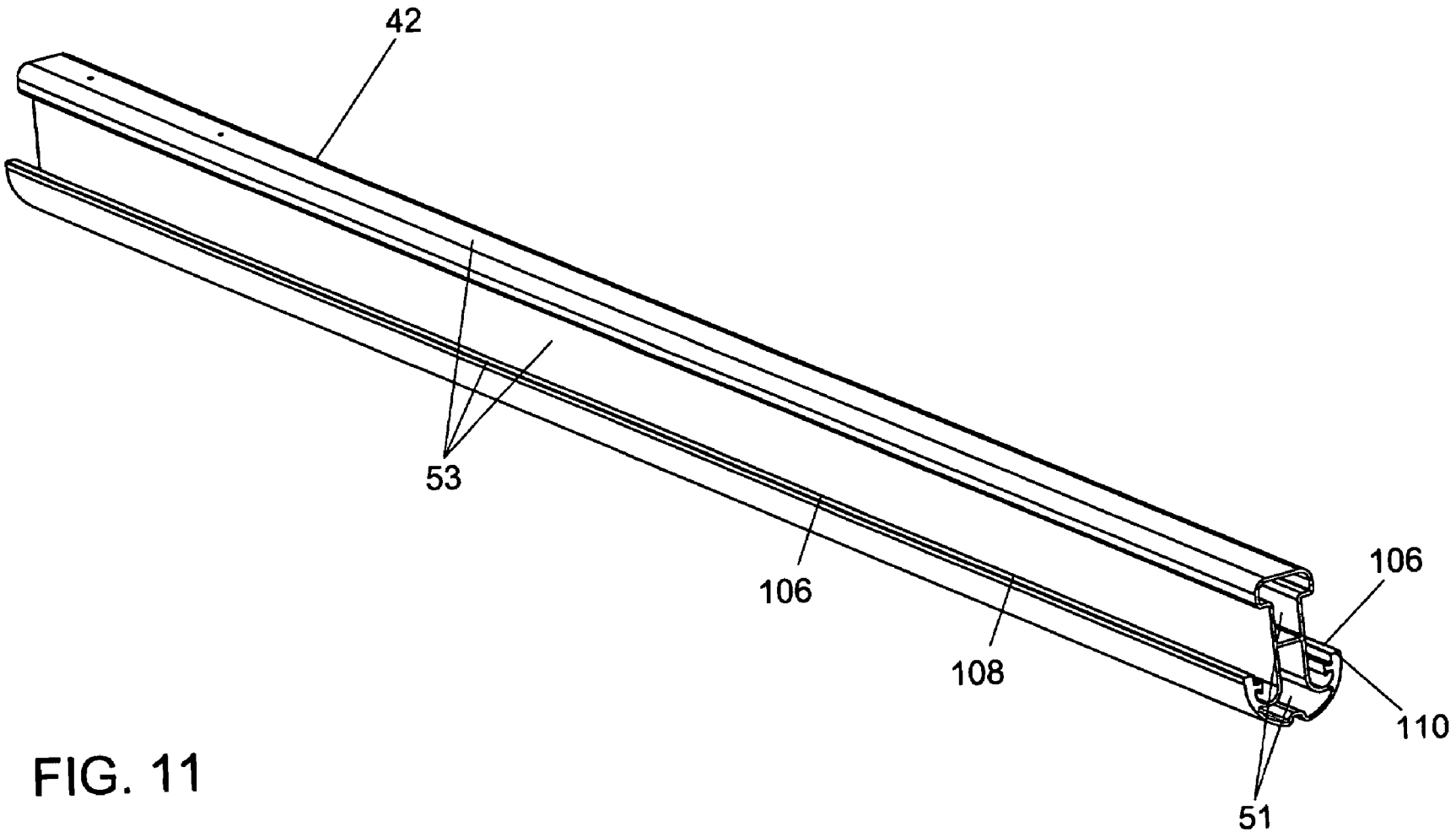
FIG. 11 is a perspective view of a bottom elongate member according to the present invention.
Figure 12:
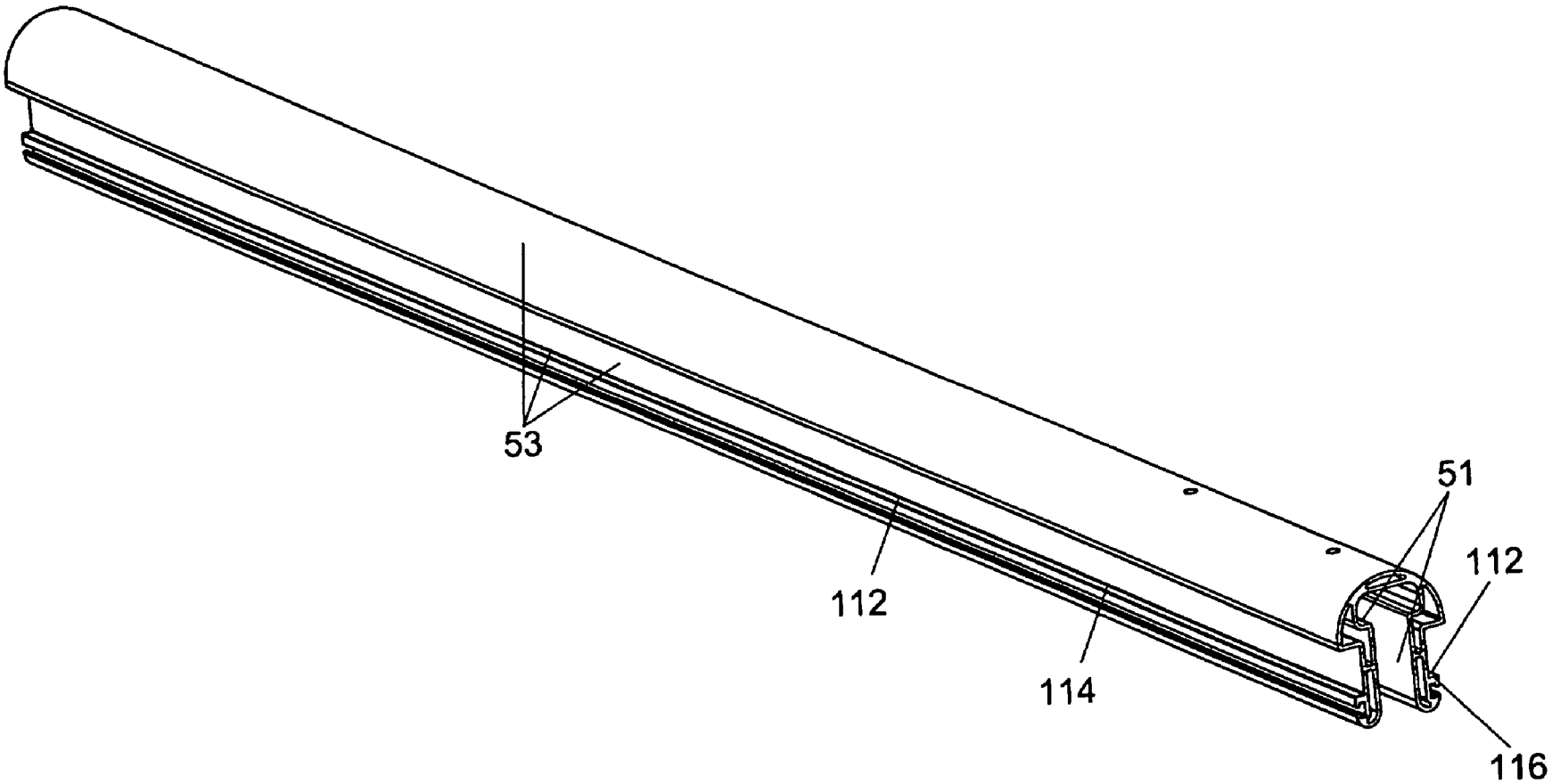
FIG. 12 is a perspective view of a top elongate member according to the present invention.
Figure 13:
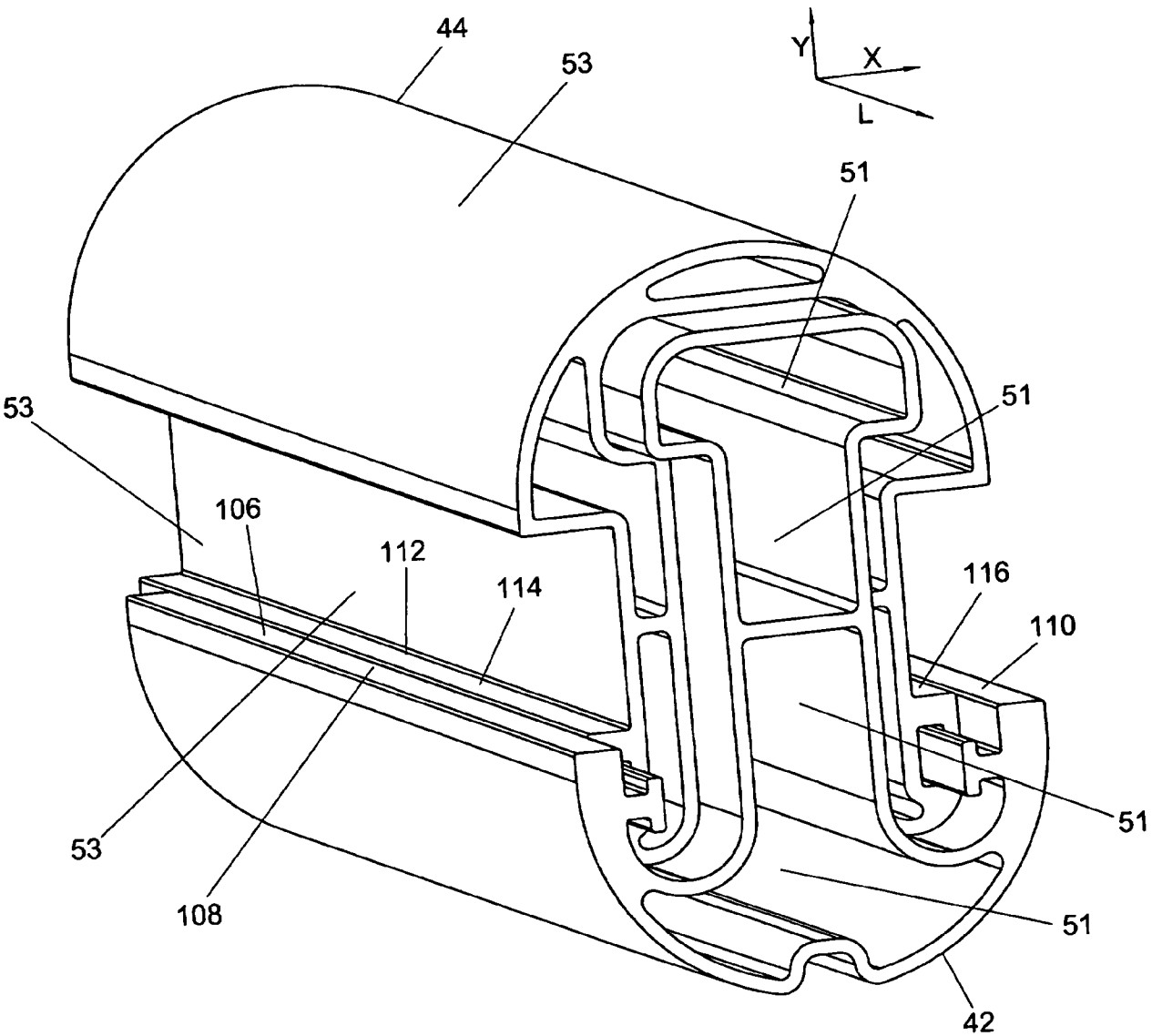
FIG. 13 is a perspective view of the top and bottom elongate members, slidably mated with one another, according to the present invention.
Figure 14:
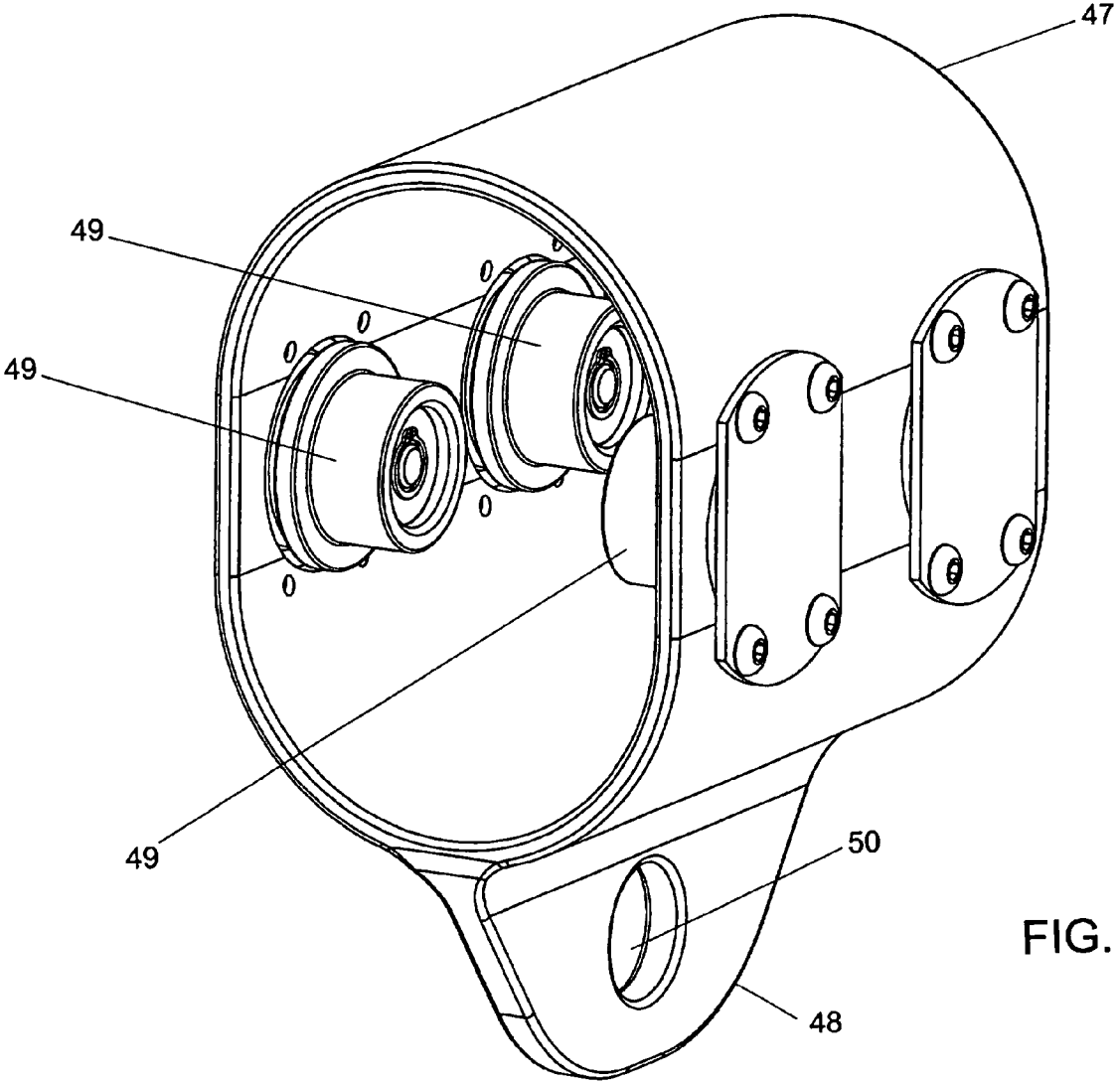
FIG. 14 is a close-up perspective view of a trolley according to the present invention.

It will be appreciated that the term "external surface" refers to surfaces accessible from outside the frame 10, and thus not surfaces inside a hollow centre of the member 38. On FIGS. 11-13, various internal surfaces are indicated by reference numeral 51, and external surfaces by reference numeral 53.

It will also be appreciated that the mounting of the trolley 46 on an external surface 53 facilitates the repair of the trolley 46. For example, if the wheels 49 malfunction, they can be repaired without disassembling the frame 10 because access to the wheels is facilitated by their being mounted on an external surface 53. By contrast, wheels mounted on an internal surface would be inaccessible.

Figure 2:
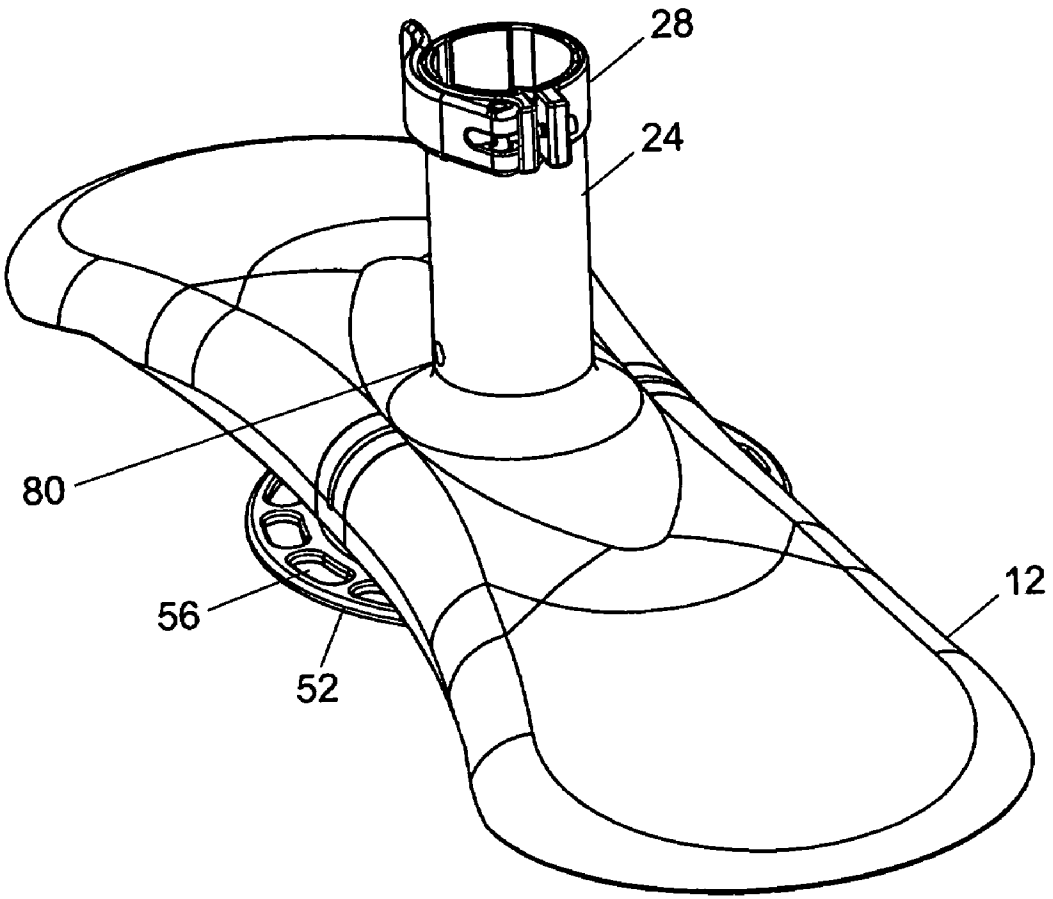
FIG. 2 is a perspective view of a floor-only stabilizer means in accordance with the present invention.

Referring now to FIG. 2, a stabilizer foot 12 is shown in close up perspective view, together with the support leg receiving portion 24 and a rigidity clamp 28. Also shown is a height adjustment actuator 52. The first and second height adjustment actuators 52 function to actuate the first and second height adjustment means, which will be more fully described below.

Figure 3:
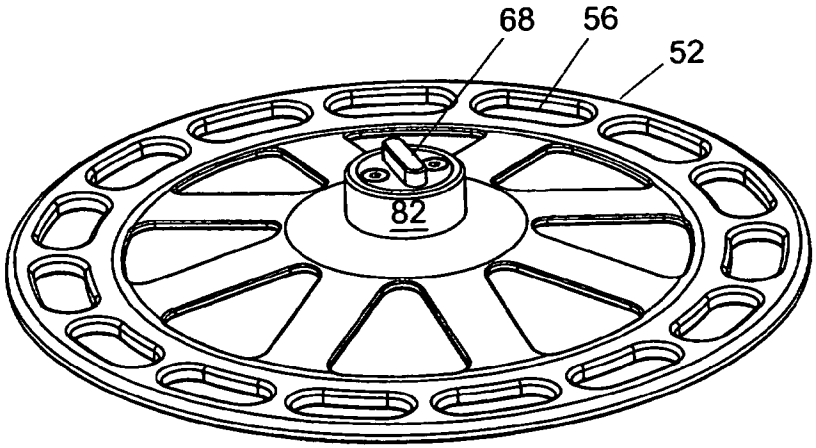
FIG. 3 is a perspective view of the top side of a height adjustment actuator according to the present invention.
Figure 4:
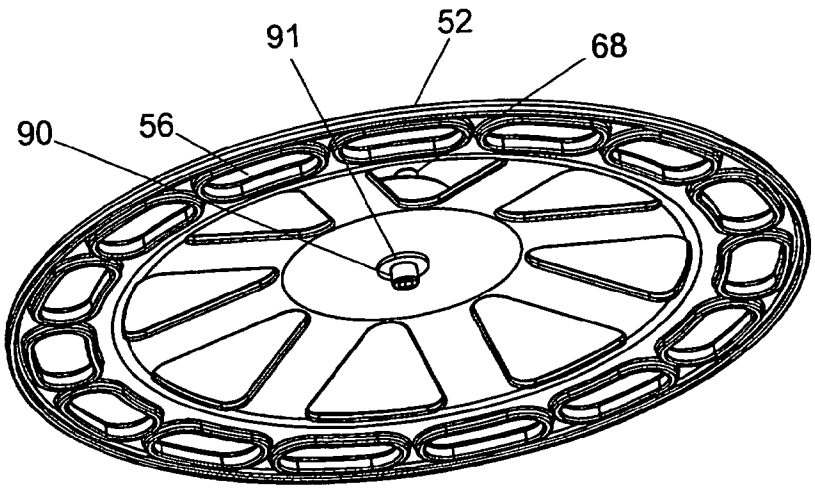
FIG. 4 is a perspective view of the bottom side of a height adjustment actuator according to the present invention.
Figure 5:
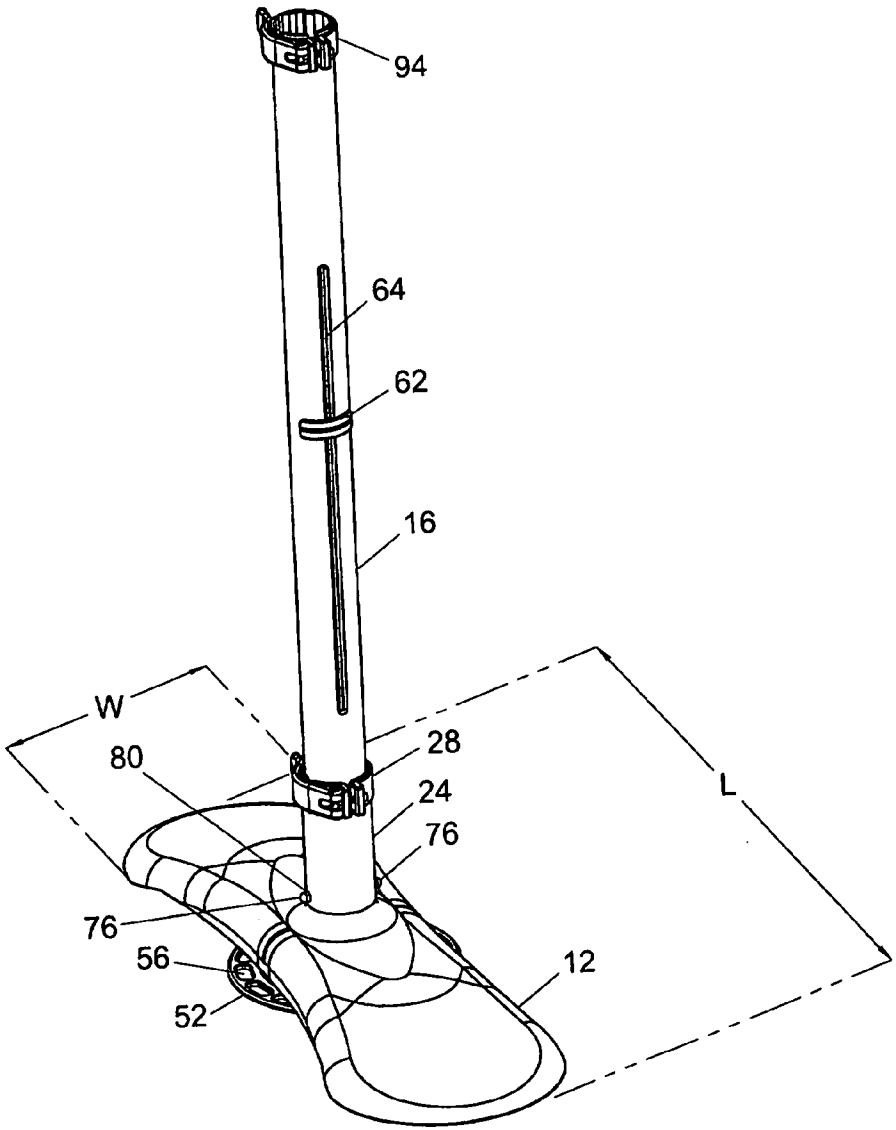
FIG. 5 is a perspective view of the lower section of a support leg, together with a floor-only stabilizer means, according to the present invention.
Figure 8:
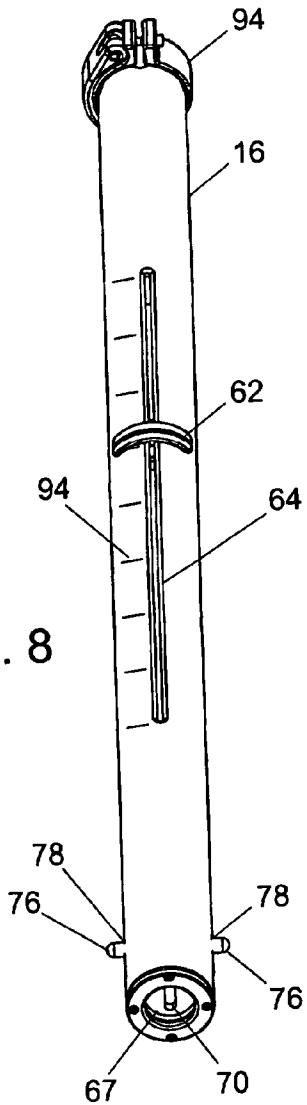
FIG. 8 is a bottom perspective view of the lower section of a support leg according to the present invention.
Figure 7:
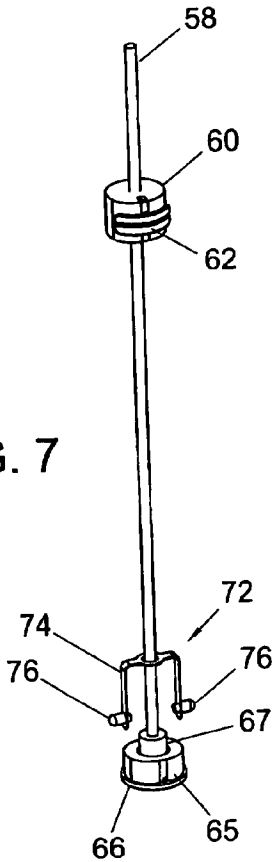
FIG. 7 is a perspective view of a portion of a height adjustment means according to the present invention.
Figure 6:
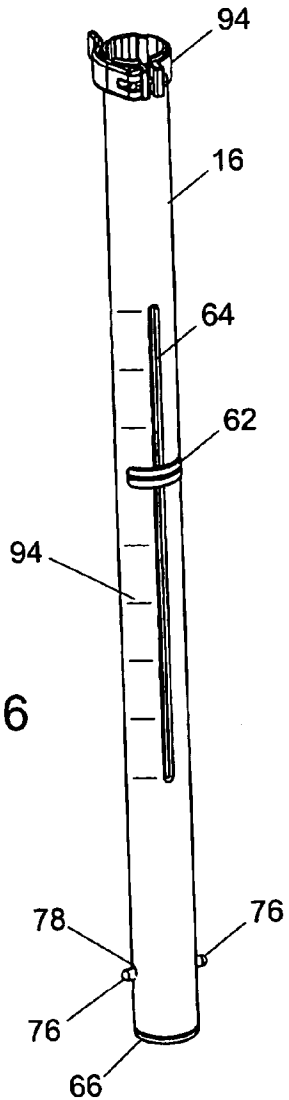
FIG. 6 is a top perspective view of the lower section of a support leg according to the present invention.
Figure 9:
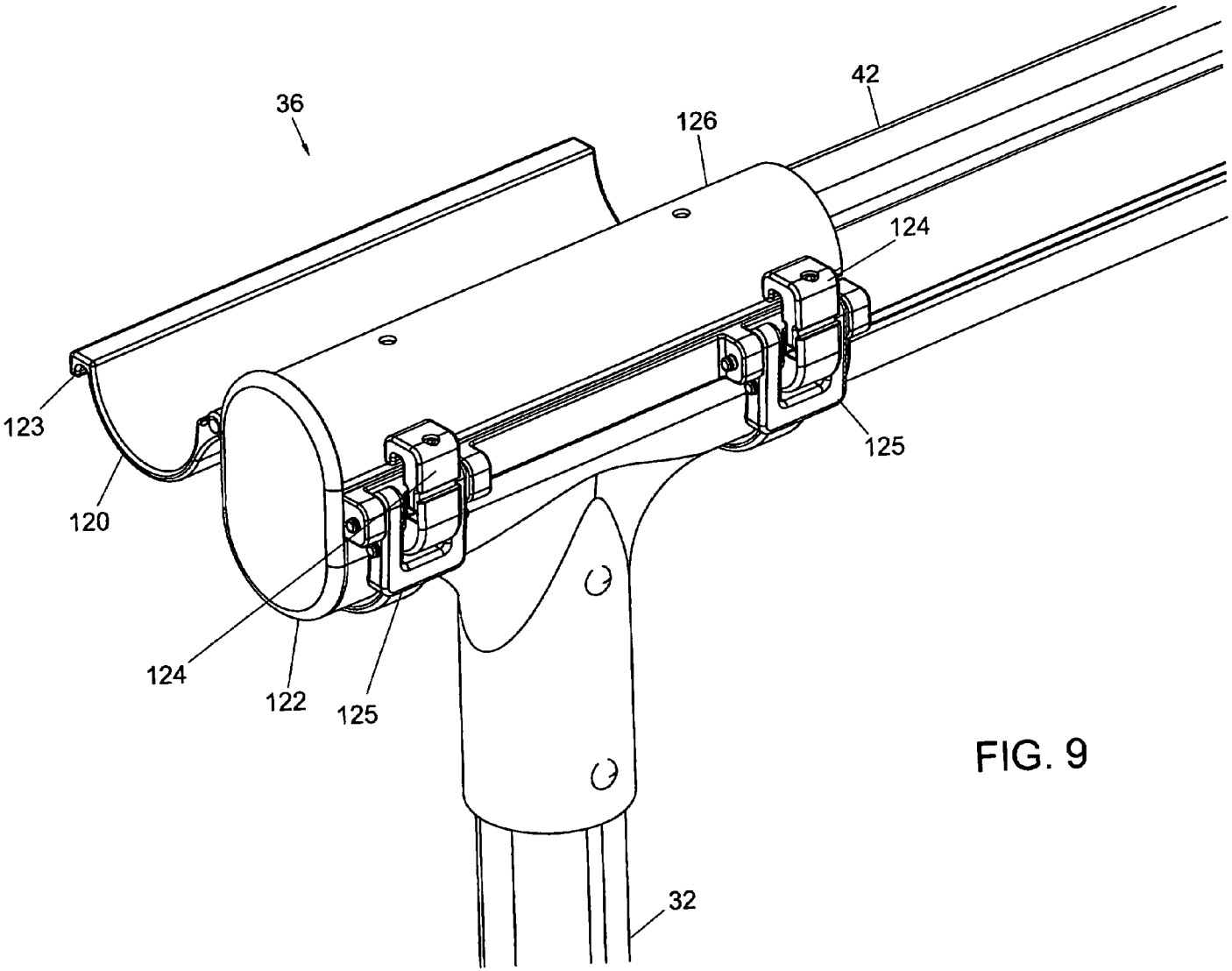
FIG. 9 is a close-up perspective view of a clamp attaching a support leg to a load support member, according to the present invention.

Referring now to FIGS. 3 and 4, the height adjustment actuators 52 are, preferably, in the shape of wheels. The stabilizer feet 12 are shaped so as to permit the height adjustment actuators 52 to extend outward past the side of the stabilizer feet 12 and to depend from the stabilizer feet 12 without touching the ground. Thus, the actuators 52 can be moved, in order to actuate height adjustment means, without being impeded by the floor.

The actuators 52 include finger grips 56, distributed around the outside of the actuators. Some of the grips 56 extend beyond the foot 12, permitting access by a user. It will be appreciated that these grips allow a user of the adjustable support frame 10 to move the actuators 52, thus adjusting the height of the support legs 18 when the frame 10 is in an assembled condition.

Referring now to FIGS. 2-8, each of the lower sections 16 is hollow and contains within it a threaded shaft 58 extending axially therethrough the shaft 58 carrying a stop member in the form of a threaded nut 60. Each threaded nut 60 carries a height indicator 62 which is positioned on an outer surface of a lower sections 16 and connected to the nut 60 through a groove 64 in each lower section 16.

The threaded shafts 58 are held within the lower sections 16 by a bottom plug 66. The plug 66 includes four screw holes 69, two of which are used to attach the plug 66, using screws, to the lower section 16, and two of which attach the bottom plug 66 to the bearing cover 65. The bearing cover 65 covers the bearing 67, which is fixed to the threaded shaft 58. When the bearing 67 turns, the threaded shaft 58 turns with it.

As can be seen in FIG. 3, the height adjustment actuators 52 are each coupled with a key carrier 82 which has a key 68 sized and shaped to mate with a key way 70 in each bearing 67. In addition, each of the lower sections 16 includes an attachment means in the form of an attachment lug assembly 72 which assembly 72 includes a lug carrier 74 and two opposing attachment lugs 76. The lug carrier 74 is anchored to the threaded shaft 58, and the lug carrier 74 acts as a spring biased outward from the shaft 58, so that if the lugs 76 are pushed inward toward the shaft 58, they will spring back outward.

The attachment lug assembly 72 is held in place by virtue of the lugs 76 being positioned as to extend outward through lug holes 78 in the lower sections 16. To assemble the frame 10, the lugs 76 are temporarily pushed inward and the lower sections 16 are inserted into the support leg receiving portions 24. The lower sections 16 are pushed inward until the lugs 76, which are attached to the spring-like lug carrier 74, pop out of the lug grabbing holes 80, two of which are located on each of the support leg receiving portions 24. The lug grabbing holes 80 are sized, shaped and positioned so that the lugs 76 will fit into them. It will be appreciated that the lugs 76, which extend out through the lug holes 78 and the lug grabbing holes 80, hold the lower sections 16 in the leg receiving portions 24. The feet 12, portions 24 and legs 18 are also adapted to permit decoupling of the feet 12 from the legs 18 by pushing the lugs 76 into the holes 80 and withdrawing the lower sections 16 from the portions 24.

The keys 68 on the actuators 52 are preferably spring loaded. When the key 68 is pressed against the bearing 67, it may or may not be positioned so as to mate with the key way 70. If not, the key 68 is pushed inward. The actuator 52 is then rotated until the key 68 lines up with the key way 70. At that point, the spring loaded key 68 will move outward and mate with the key way 70. From then on, when the actuator 52 is rotated, the bearing 67 will rotate with it, thus rotating the threaded shaft 58.

Figure 15:
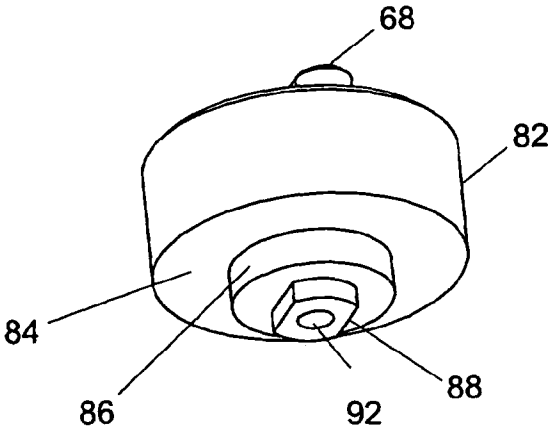
FIG. 15 is a bottom perspective view of a key carrier according to the present invention.
Figure 16:
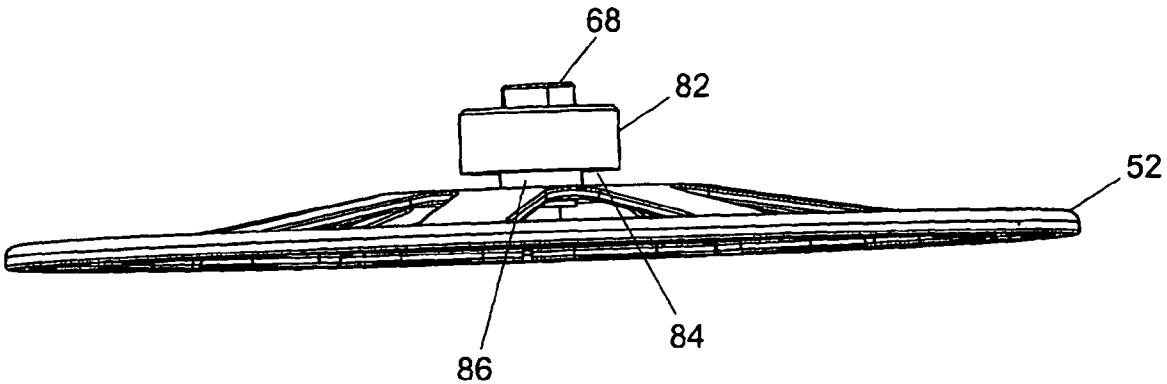
FIG. 16 is a side elevation view of a height adjustment actuator and key carrier according to the present invention.

Referring now to FIGS. 2, 15 and 16, in assembling the actuator 52 and foot 12, the key carrier 82 is inserted into the support leg receiving portion 24, with the key 68 facing upward toward the key way 70. The support leg receiving portion 24 sized and shaped to have a hole at the bottom whose diameter is smaller than the surface 84, but larger than the spacer 86. The spacer 86 thus extends downward past the bottom surface of the foot 12, as does the actuator key 88, while the key carrier 82 is held in the leg receiving portion 24. The spacer 86 on the key carrier 82 functions to space the actuator 52 from the foot 12 thus allowing the actuator 52 to move freely. The actuator key 88 on the key carrier 82 is sized and shaped to fit into a corresponding opening in the actuator 52. The actuator 52 is attached to the key carrier 82 by means of a screw 90 and washer 91. The screw 90 screws into a hole 92 in the key carrier 82. For easy assembly, the screw 92 is a hand-tightened screw, whose function is to hold the actuator 52 to the key carrier 82. Once this assembly is complete, the actuator 52 is coupled to the shaft 58 through the actuator key 88, the key carrier 82, the key 68, the key way 70 and the plug 66. When the actuator 52 is rotated, the shaft 58 rotates.

The nut 60 is preferably sized and shaped so that when positioned inside the hollow centre of the lower sections 16, the nut 60 cannot rotate. Preferably, the nut 60 has two flat sides (in addition to its top and bottom sides), and the hollow centres of the lower portions 16 are shaped with flat surfaces that bear against and match the flat sides of the nut 16. The result is that the nut 16, when inserted into the hollow centres of the lower sections 16, cannot rotate.

The upper sections 32 are preferably sized, shaped and positioned so as to extend into the hollow centres of the lower sections 16 and be axially slidably mateable therewith. The height of the legs 18 is adjusted by sliding the upper section 32 relative to the lower section 32. The upper sections 32 rest on the nut 60 carried by the shaft 58 and located within the lower sections 16, 20. The upper sections 32 can be decoupled from the lower section 16 by sliding the upper sections 32 axially away from and out of the lower sections 16.

It can now be appreciated how the height of the load supporting member is adjusted. If it is desired to cause the upper section 32 to move, the actuator 52 is rotated. As the actuator 52 is coupled, as described above, to the threaded shaft 58, the threaded shaft 58 rotates. The nut 60, which is threaded onto the shaft 58 and which is sized and shaped so as to be prevented from rotating, is forced to move by the rotation of the shaft 58. In this way, the nut 60 can be moved up or down by the rotation of the actuator 52. If the actuator 52 is rotated in one direction, the nut 60 will move upward, and if the actuator 52 is rotated in the opposite direction, the nut 60 will move downward. Because the upper section 32 rests on the nut 60, thus coupling the upper sections 32 to the lower sections 16, the upper sections 32 will also move up or down in response to the rotation of the actuators 52. The movement of the nut 60 slides the upper section 32 relative to the lower section 16. The upper sections 32 are preferably also hollow to accommodate the shaft 58. Specifically, when the nut 60 moves down, the shafts 58 will extend into the hollow centres of the upper sections 32. Thus, the height of the legs 18 and member 38 are adjusted.

It will be appreciated that the configuration of the preferred height adjustment means, namely, the threaded shaft 58 and nut 60, permits the continuous adjustment of the height, rather than only discrete adjustment. This is advantageous because more precise height adjustment is possible. It will be appreciated that the invention comprehends other means of continuous height adjustment apart from the preferred means described in detail above. It will also be appreciated that continuous height adjustment, through preferred, is not required for the invention.

It will also be appreciated that the two height adjustment means are configured to permit independent height adjustment of the two support legs 18. Thus, the frame 10 can be positioned with the first leg 12 on a first floor having a first level and the second leg on a second floor having a second, different level. Because independent height adjustment of the legs 18 is possible, the member 38 can be maintained in a generally horizontal orientation even when each leg 18 is resting on a floor having a different level. This creates greater flexibility for the frame 10, which can be used in a greater number of environments. It will be appreciated that the invention comprehends other configurations, apart from the preferred embodiment described herein, for independent height adjustment of the legs 18. It will also be appreciated that independent height adjustment, through preferred, is not required for the invention.

Preferably, the height indicator 62 shows the height of the support leg 18 with the aid of a height scale 94 which communicates to the user the height of the support leg 12 associated with various positions of the height indicator 62.

It will be appreciated that the actuators 52, key carriers 82, plugs 66, nuts 60, shafts 58, bearing 67 and indicators 62 together comprise two height adjustment means, one associated with each support leg 18, for adjusting the height of each support leg. Although the preferred height adjustment means are described in detail above, it will be appreciated that the invention comprehends other means for adjusting the height of the support legs 18.

The frame 10 further comprises rigidity clamps 94 which substantially reduce the play between the lower sections 16 and the upper sections 32 when the frame 10 is in its assembled condition. It will be appreciated that, when it is desired to adjust the height of the load support member 38, the rigidity clamps 94 are released to allow the upper sections 32 to move freely. Once the height has been adjusted, the rigidity clamps 94 are refastened.

Referring now to FIGS. 10-13, the preferred load support member 38 comprises a lower elongate member 42 and an upper elongate member 44. The trolley 46 is movably mounted on an external surface of the load support member 38. The trolley 46 and load support member 38 are sized and shaped to permit the trolley 46 to move along substantially the entire length of the load support member 38.

The lower elongate member 42 and upper elongate member 44 are sized and shaped so as to be mateable with one another by the slidable axial engagement of the lower elongate member 42 and the upper elongate member 44. The result is that the elongate members 42, 44 are movable relative to one another in the axial directions, and can only be disengaged by sliding the elongate members in opposite axial directions. However, the elongate members 42, 44, are sized and shaped so that they cannot be disengaged by attempting to move them apart in a direction other than a axial direction. "Axial" refers to a direction along the length of the elongate members 42, 44.

Figure 10:
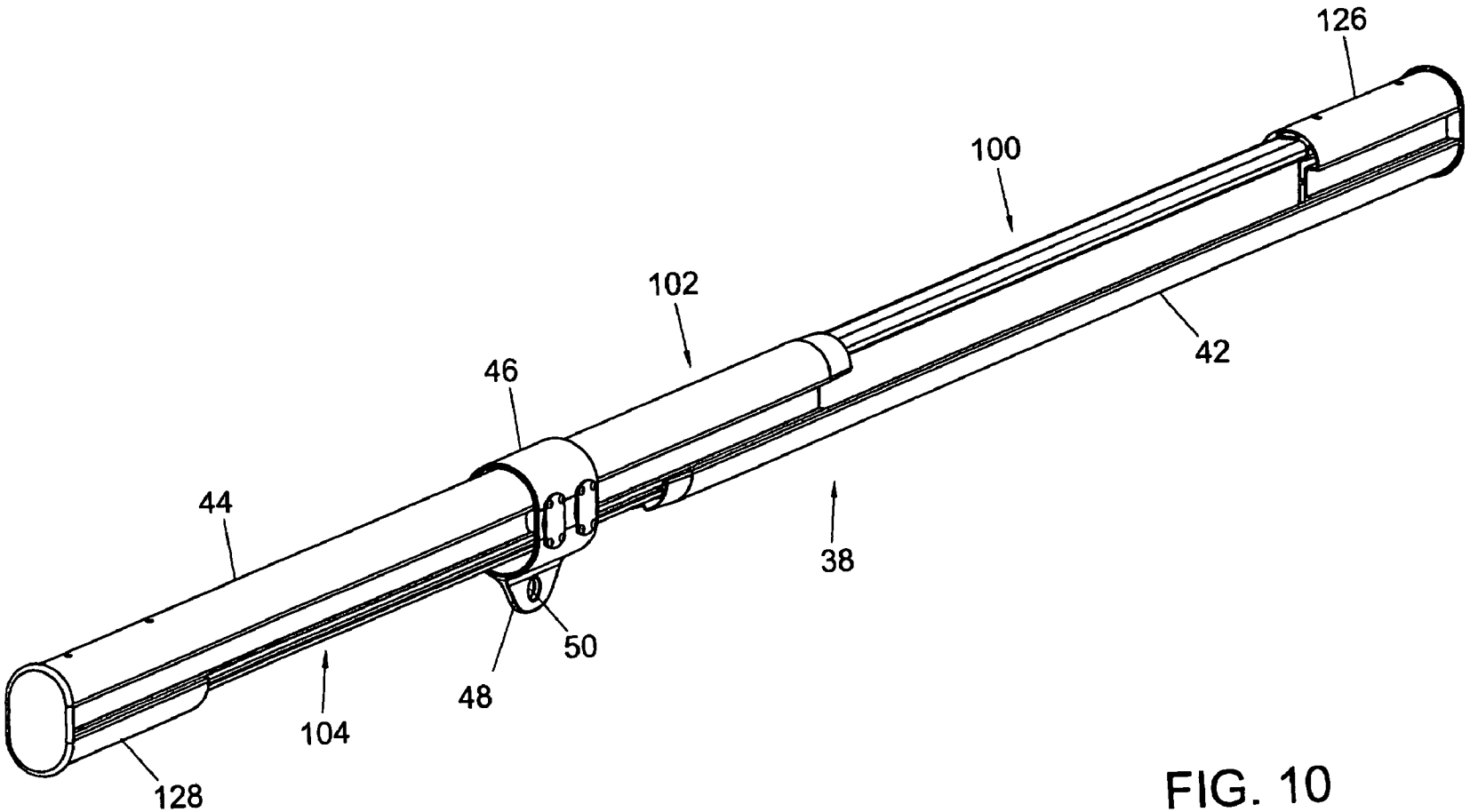
FIG. 10 is a perspective view of a load support member, carrying a trolley, according to the present invention.

It will be appreciated that, because the load supporting member 38 is comprised of two elongate members 42, 44 slidably axially mated with one another, different portions of the load support member 38 will have different external shapes. As shown in FIG. 10, the right-most portion 100 of the load support member 38 comprises the lower elongate member 42 only, and is shaped accordingly. In the middle portion 102, the lower and upper elongate members 42, 44 are overlapped, and the middle portion of the load support member 38 has a composite shape. With respect to the left-most portion 104, this is comprised of the upper elongate member 44 only, and is shaped accordingly.

The lower elongate member 42 preferably includes a first wheel-bearing surface, generally designated by reference numeral 106, which includes a lower member first-and-second wheel bearing surface 108 and a lower member third-and-fourth wheel bearing surface 110. The upper elongate member 44 preferably includes a second wheel-bearing surface, generally designated by reference numeral 112, which includes an upper member first-and-second-wheel bearing surface 114 and an upper member third-and-fourth-wheel bearing surface 116.

The first and second wheel-bearing surfaces are preferably sized, shaped and positioned so as to permit the trolley 46 to move continuously from the upper elongate member 44 to the lower elongate member 42. Most preferably, this is achieved by having the first wheel-bearing surface 106 and the second wheel-bearing surface 112 both be positioned in a substantially co-planer horizontal orientation when the frame 10 is assembled. Also, when the frame 10 is assembled, the upper member first-and-second wheel bearing surface 114 and the lower member first and second wheel bearing surface 108 are positioned side-by-side in the portion 102 of the member 38 where the upper and lower members 42, 44 overlap. Also, preferably, the surfaces 108, 110, 114 and 116 are about one half as wide as the trolley wheels 49. As a result, when the trolley is positioned on the portion 104 which comprises only the upper member 44, the wheels 49 bear only on the surfaces 114, 116. In portion 102, the surface 108 is side by side with the surface 114 and the surface 110 is side by side with the surface 116. Thus, the trolley 46 can move along the member 38 to the portion 102 without interference. In the portion 102, the wheels 49 will bear on the surfaces 108, 110, 114, 116. The trolley can also move without interference to the portion 100, where the wheels 49 will bear on the surfaces 108, 110, because the surfaces 108, 110 are positioned to as to permit continuous movement of the trolley from surfaces 114, 116 to surfaces 108, 110.

Thus, it will be appreciated that the surfaces 108 and 114 together form a first-and-second wheel-bearing surface, along the length of one side of the member 38, for bearing first and second wheels 49 of the trolley 46, which wheels are positioned on the one side of the member 38 when the frame 10 is assembled. Also, surfaces 110 and 116 together form a third-and-fourth wheel-bearing surface along the opposite side of the length of the member 38 for bearing the third-and-fourth wheels of the trolley 46, which wheels are positioned on the said opposite side of the member 38 when the frame 10 is assembled.

The frame 10 preferably further includes first and second openable clamps 36 which are configured and positioned to detachably attach the first and second upper sections 32 to the load support member. Preferably, a clamp 36 is attached to the top end of each upper section 32. Most preferably, one clamp 36 is configured and positioned to detachably attach the upper member 44 to one of the upper sections 32, while the other clamp 36 is configured and positioned to detachably attach the lower member 42 to the other upper section 32.

Each clamp 36 preferably includes a clamp cover 120, a clamp body 122, and two closures 124. Preferably, the two clamps 36 are interchangeable, thus reducing the cost and complexity of manufacturing and assembling the frame 10. It will be appreciated that, because of the structure of the member 38, one clamp 36 will clamp the upper member 44 to an upper section 32, while the other clamp 36 will clamp the lower member 42 to the other upper section 32. Thus, though the clamps 36 are preferably interchangeable, the shapes of the upper and lower members 44, 42 are different.

These different shapes are accommodated by the interchangeable clamps 36 as follows. Positioned at the end of the lower member 42 that is acted on by the clamp 36 is an upper filler piece 126. The upper filler piece 126 is mated with the lower member 42 in the same way that the upper member 44 is, and has the same shape as the upper member 44. Similarly, positioned at the end of the upper member 42 that is acted on by the clamp 36 is a lower filler piece 128 which has the same shape as the lower member 42. The lower filler piece 128 is mated with the upper member 44 in the same way that the lower member 42 is.

It will therefore be appreciated that the clamps 36 act on the upper filler piece 126, mated with the lower member 42, at one end of the load support member 38, and on the lower filler piece 128, mated with the upper member 44, at the other end. Because the upper filler piece 126 is the same shape as the upper member 44, and because the lower filler piece 128 is the same shape as the lower member 42, the portions of the load support member 38 where the filler pieces 126, 128 are positioned are both the same shape. Thus, identical clamps 36 can be used at both locations.

To attach the member 38 to the support legs 18, the ends of the member 38, with the filler pieces 126, 128 positioned as described above, are placed in the clamp bodies 122. The clamp covers 120 are closed so that the clamp lips 123 are gripped and held by the closures 124, and pressure is exerted on the ends of the member 38 to attach it to the upper sections 32. To open the clamp and detach the member 38, the closure tabs 125 of the closures 124 are lifted so as to release the clamp lips 123, and the clamp covers 120 are pulled back so that the member 38 is no longer attached.

As described above, the feet 12 extend outward on both sides of the plane of the member 38 and legs 18 to stabilize the frame 10 in a standing position. The preferred feet 102 have a shape having a length L which is greater than their width W (see FIG. 5). Preferably, the legs 18, lug grabbing holes 80, leg receiving portions 24 and feet 12, are sized shaped and positioned to ensure that the feet 12 extend lengthwise at a 90 degree angle away from the plane when the frame 10 is assembled. Specifically, hollow centre of the lower sections 16 are shaped to be elliptical, as is the outer surface of the upper sections 32. The orientation of these ellipses, together with the positioning of the lug grabbing holes 80 on the portion 24, ensures that the length of the feet 12 is always perpendicular to the plane.

It will be appreciated that the invention as herein described is easy to assemble, disassemble and transport. Specifically, to disassemble the frame 10, the member 38 is decoupled from the legs 18, the upper sections 32 are decoupled from the lower sections 16, and the feet 12 are decoupled from the lower sections 16. The member 38, though preferably composed of two elongate member 42, 44, can be carried as one piece because the elongate members are axially mated. Thus, once disassembled, the preferred frame 10 comprises seven easy-to-carry pieces.

The frame 10 may be assembled as follows: the feet 12 are coupled to the lower sections 16, which are coupled to the upper sections 32. The heights of legs 18 can be adjusted to the estimated requirements. The length of the member 38 can also be adjusted to estimated requirements. Then, the member 38 can be clamped into the clamps 36, whereupon the height of the legs 18 and length of the member 38 can be adjusted again for precision. It will be appreciated that the other modes of assembly, disassembly and transport are possible within the scope of the invention. It will also be appreciated that the ease of assembly, disassembly and transport makes the preferred frame 10 useful for applications such as temporary patient care by travelling caregivers.

It will be appreciated that, though the frame 10 can be used for various types of loads and applications, the preferred use is for lifting and/or moving of patients. For this application, it is preferred that the legs 18 be configured to permit the adjustment of their height between about 6.5 and nine feet from the floor(s). It is also preferred that the member 38 be configured so that its length is adjustable between about 6.5 and nine feet. However, it will be appreciated that these dimensions can be changed to accommodate the specifics of different applications, and that the invention comprehends other configurations besides the preferred one described.

Various modifications and alterations are possible to the form of the invention without departing from the scope of the broad claims attached hereto. For example, other forms of load support member may be used. Also, other means for adjusting the length of the support member or the height of the support legs may be used. What is important is that the member 38 be length adjustable to accommodate different spaces and loads.

The embodiments of the invention in which an exclusive property or privilege is claimed are defined as follows:

1. A frame for supporting and moving a load, the frame comprising:

first and second support legs for supporting said frame in at least one floor;

a load support member, extending between the first support leg and the second support leg, wherein the load support member is sized and shaped such that the length of the load support member is adjustable; and a trolley to which a load may be attached, movably mounted on an external surface of the load support member and having wheels such that access to the wheels of the trolley without the disassembly of the frame is facilitated, the trolley and load support member being sized and shaped to permit the trolley to move along the load support member, wherein the load support member comprises a first elongate member with a first wheel-bearing surface coupled to the first support leg and a second elongate member with a second wheel-bearing surface coupled to the second support leg, the elongate members being sized and shaped such that the first elongate member is axially slidably mateable with the second elongate member to form said load support member and the first and second wheel-bearing surfaces are sized and positioned so as to permit the trolley to move continuously from the first elongate member to the second elongate member.

2. A frame as claimed in claim 1, wherein the legs are configured to be detachable from the load support member;

and wherein the first support leg comprises a first upper section attached to the load support member and a first lower section coupled to the first upper section, the first upper section being axially slidably mateable with the first lower section, wherein the height of the first support leg is adjustable by sliding the first upper section relative to the first lower section;

and wherein the second support leg comprises a second upper section attached to the load support member and a second lower section coupled to the second upper section, the second upper section being axially slidably mateable with the second lower section, wherein the height of the second support leg is adjustable by sliding the second upper section relative to the second lower section;

and wherein the first upper section and first lower section are sized and shaped to be decouplable by sliding the first upper section axially away from the first lower section, and the second upper section and second lower section are sized and shaped to be decouplable by sliding the second upper section axially away from the second lower section.

3. A frame as claimed in claim 1, wherein the trolley includes a trolley cover sized and shaped to surround the load support member sufficiently so that if the trolley fails, the trolley cover will grip the load support member;

whereby the load will continue to be supported if the trolley wheels fail.

4. A frame as claimed in claim 1, wherein the first support leg and the second support leg are configured to be height adjustable.

5. A frame as claimed in claim 4, wherein the first support leg and second support leg are configured to be height adjustable independently from one another, whereby the frame may be effectively used with the first support leg resting on a first floor having a level and the second support leg resting on a second floor having a different level.

6. A frame as claimed in claim 5, wherein the first support leg comprises a first upper section attached to the load support member and a first lower section coupled to the first upper section, the first upper section being axially slidably mateable with the first lower section, wherein the height of the first support leg is adjustable by sliding the first upper section relative to the first lower section;

and wherein the second support leg comprises a second upper section attached to the load support member and a second lower section coupled to the second upper section, the second upper section being axially slidably mateable with the second lower section, wherein the height of the second support leg is adjustable by sliding the second upper section relative to the second lower section.

7. A frame as claimed in claim 6, wherein the frame further comprises a first height adjustment means, associated with the first upper and lower sections, for adjusting the height of the first support leg, and a second height adjustment means, associated with the second support leg, for adjusting the height of the second support leg.

8. A frame as claimed in claim 7, wherein the first and second height adjustment means are configured to permit continuous adjustment of height.

9. A frame as claimed in claim 8, wherein the first height adjustment means comprises a first threaded shaft extending axially through the first lower section, the first threaded shaft being axially fixed and rotatably movable relative to the first lower section, and a first stop member, the first stop member being configured to move along the first threaded shaft in response to rotation of the first threaded shaft, the first stop member and the first upper section being mutually positioned such that the first upper section moves in response to movement of the first stop member, whereby the height of the first support leg is adjusted.

10. A frame as claimed in claim 9, wherein the second height adjustment means comprises a second threaded shaft extending axially through the second lower section, the second threaded shaft being axially fixed and rotatably movable relative to the second lower section, and a second stop member, the second stop member being configured to move along the second threaded shaft in response to rotation of the second threaded shaft, the second stop member and the second upper section being mutually positioned such that the second upper section moves in response to movement of the second stop member, whereby the height of the second support leg is adjusted.

11. A frame as claimed in claim 10, wherein the first height adjustment means comprises a first actuator, coupled to the first threaded shaft, for rotating the first threaded shaft to adjust the height of the first support leg, the first actuator being sized, shaped and positioned to permit height adjustment, and wherein the second height adjustment means comprises a second actuator, coupled to the second threaded shaft, for rotating the second threaded shaft to adjust the height of the second support leg, the second actuator being sized, shaped and positioned to permit height adjustment.

12. A frame as claimed in claim 11, wherein the first height adjustment means further comprises a first height indicator coupled to the first stop member and positioned so as to visually indicate a height of the first support leg, and wherein the second height adjustment means further comprises a second height adjustment indicator coupled to the second stop member and positioned so as to visually indicate a height of the second support leg.

13. The frame as claimed in claim 1, wherein the first and second support legs are detachably attached to the load support member.

14. The frame as claimed in claim 13, the frame further including a first openable clamp configured and positioned to detachably attach the first support leg to the load support member, and a second openable clamp configured and positioned to detachably attach the second support leg to the load support member.

15. The frame of claim 1, wherein the trolley comprises first and second trolley wheels positioned on a side of the load support member and third and fourth trolley wheels positioned on an opposite side of the load support member, and wherein the wheel bearing surfaces comprise the first-and-second wheel bearing surface and a third-and-fourth-wheel bearing surface.

16. The frame as claimed in claim 1, wherein the first and second support legs are detachably attached to the load support member, and wherein the first elongate member and second elongate member are detachable from one another by sliding the first elongate member and the second elongate member apart in an axial direction.

17. A frame as claimed in claim 1, wherein the frame further comprises a floor-only stabilizer means, associated with said support legs, for stabilizing said frame in a standing position, said floor-only stabilizer means being sized and shaped to stabilize said frame in a standing position by acting only on the at least one floor.

18. A frame as claimed in claim 17, wherein the floor-only stabilizer means comprises a first stabilizer foot coupled to the first support leg and a second stabilizer foot coupled to the second support leg.

19. A frame as claimed in claim 18, wherein the first and second stablizer feet are adapted to be decouplable from the first and second support legs.

20. A frame as claimed in claim 18, wherein the support legs and load support member are shaped and positioned so as to lie substantially in a single plane, and wherein the first and second stabilizer feet extend away from the plane, on both sides of the plane, sufficiently to stabilize the frame in a standing position by acting only on the at least one floor.

21. A frame as claimed in claim 20, wherein the stabilizer feet each have a length, and a width that is shorter than the length, and wherein the support legs and stabilizer feet are sized shaped and positioned so that the feet extend lengthwise at an angle substantially perpendicular to the plane when the frame is in an assembled condition.

* * * * *

UNITED STATES PATENT AND TRADEMARK OFFICE

CERTIFICATE OF CORRECTION

PATENT NO. : 8,099,806 B2
APPLICATION NO. : 10/575115
DATED : January 24, 2012
INVENTOR(S) : Mark P. Chepurny et al.

It is certified that error appears in the above-identified patent and that said Letters Patent is hereby corrected as shown below:

Face of the Patent, Column 1, Item (87) PCT Pub. No., Line 1, delete "WO2005/132446" and insert -- WO2005/032446 --

On the face of the patent insert
-- (30) Foreign Application Priority Data
Oct. 9, 2003 (CA) 2,445,043 --

Column 14, Line 26, Claim 21, "sized shaped" should read -- sized, shaped --

Signed and Sealed this
Twenty-ninth Day of May, 2012

David J. Kappos

David J. Kappos
*Director of the United States Patent and Trademark Office*